United States Patent [19]

Blackman

[11] Patent Number: 4,838,414

[45] Date of Patent: Jun. 13, 1989

[54] BASKET CARRIER AND INTERNESTING BLANKS THEREFOR

[75] Inventor: Stephen M. Blackman, Westmont, Ill.

[73] Assignee: Federal Paper Board Company, Inc., Montvale, N.J.

[21] Appl. No.: 71,300

[22] Filed: Jul. 9, 1987

Related U.S. Application Data

[63] Continuation-in-part of Ser. No. 940,617, Dec. 11, 1986, Pat. No. 4,782,943.

[51] Int. Cl.[4] ..... B65D 5/46

[52] U.S. Cl. ..... 206/175; 206/185; 206/188; 229/52 B; 229/DIG. 9

[58] Field of Search ..... 206/143, 170, 174, 176, 206/185, 188, 191, 175; 229/41 B, 52 B, 52 BC, DIG. 9

[56] References Cited

U.S. PATENT DOCUMENTS

| | | | |
|---|---|---|---|
| 2,389,318 | 11/1945 | Lebold | 206/170 |
| 2,712,397 | 7/1955 | Kowal | 206/185 |
| 3,721,368 | 3/1973 | Arneson | 229/52 BC |
| 4,312,446 | 1/1982 | Summers | 206/185 |
| 4,509,640 | 4/1985 | Joyce | 206/170 |
| 4,610,349 | 9/1986 | Schwartz et al. | 229/52 BC |

*Primary Examiner*—David T. Fidei

*Attorney, Agent, or Firm*—Charles E. Brown; Charles A. Brown

[57] ABSTRACT

A basket carrier of the type including a base having a plurality of handles projecting upwardly therefrom, the handles also functioning as partitions so as to divide the base into a plurality of individual spaces for receiving cups, bottles and the like. The same basic basket carrier can be formed from two different blanks. It has been found that by providing two different blanks, a full nesting of the blanks may be obtained so that the blanks may be formed from a web with substantially no loss, thereby reducing the amount of paperboard required to form the blanks. The resultant carriers differ primarily in that one carrier includes one double handle and two single handle arrangements and the other carrier has two double handle arrangements. The carriers differ also in the manner in which the various portions are connected together by way of different arrangements of glue flaps.

17 Claims, 3 Drawing Sheets

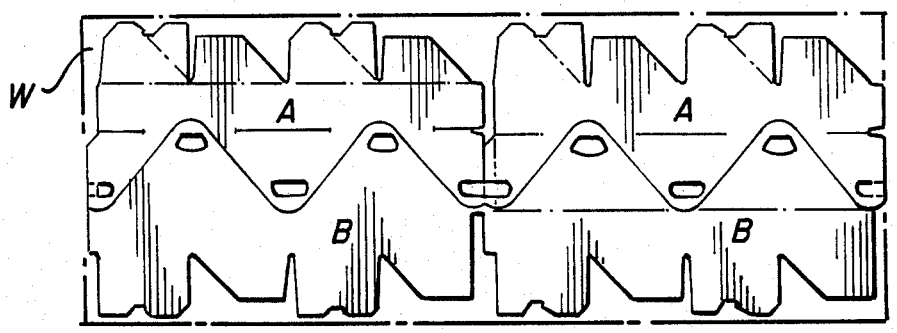
FIG. 1
FIG. 2
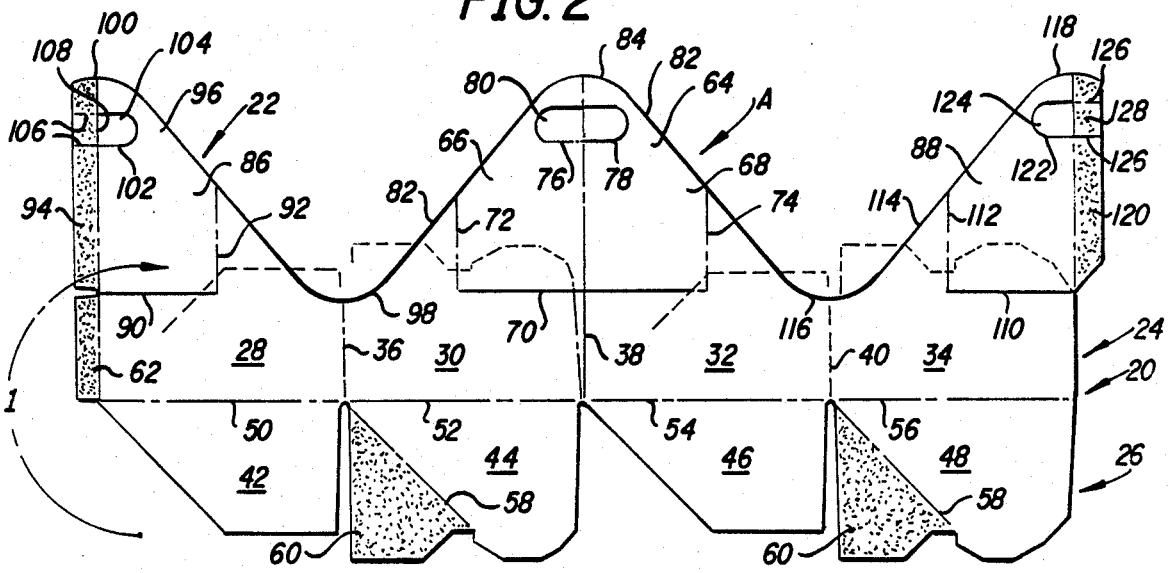
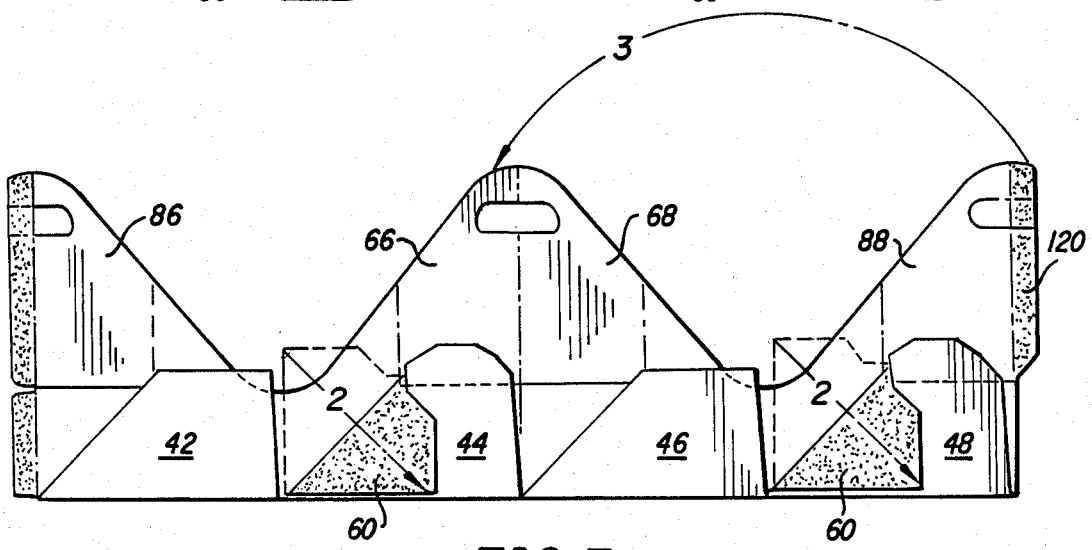
FIG. 3

FIG. 4
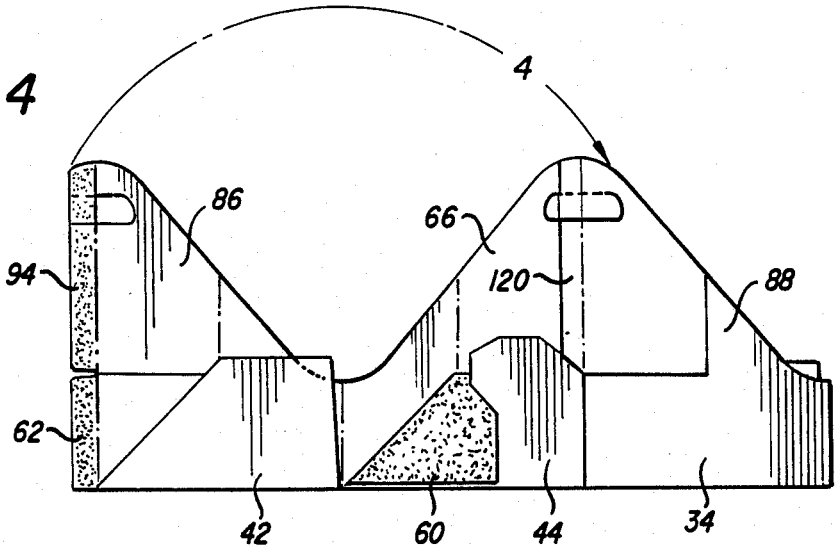
FIG. 5
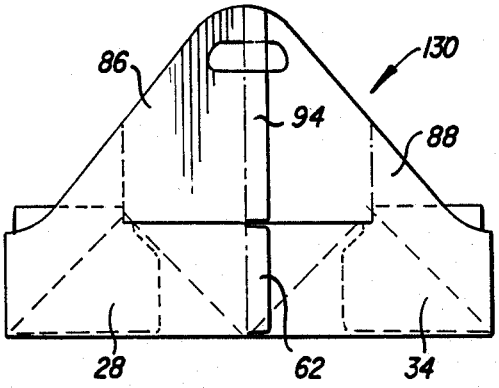
FIG. 6
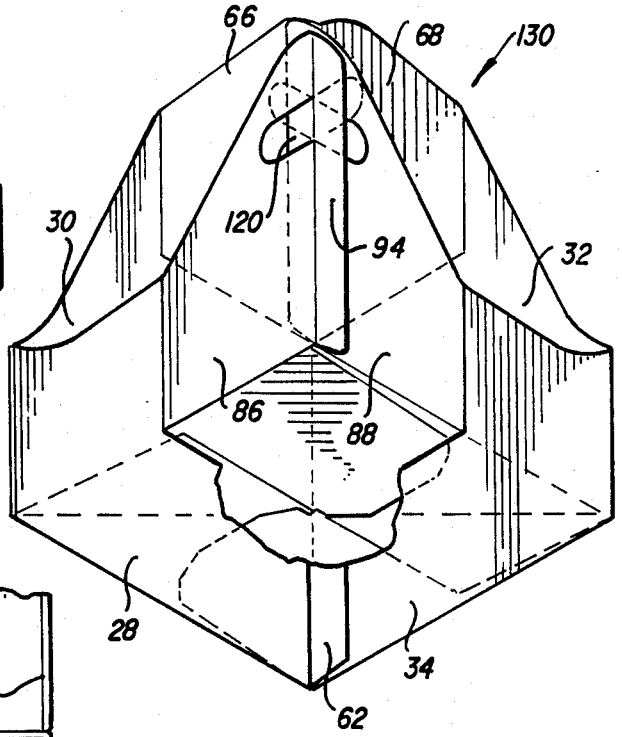
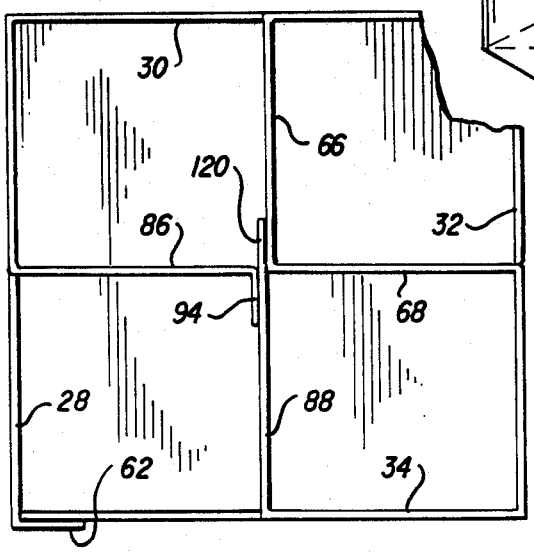
FIG. 7

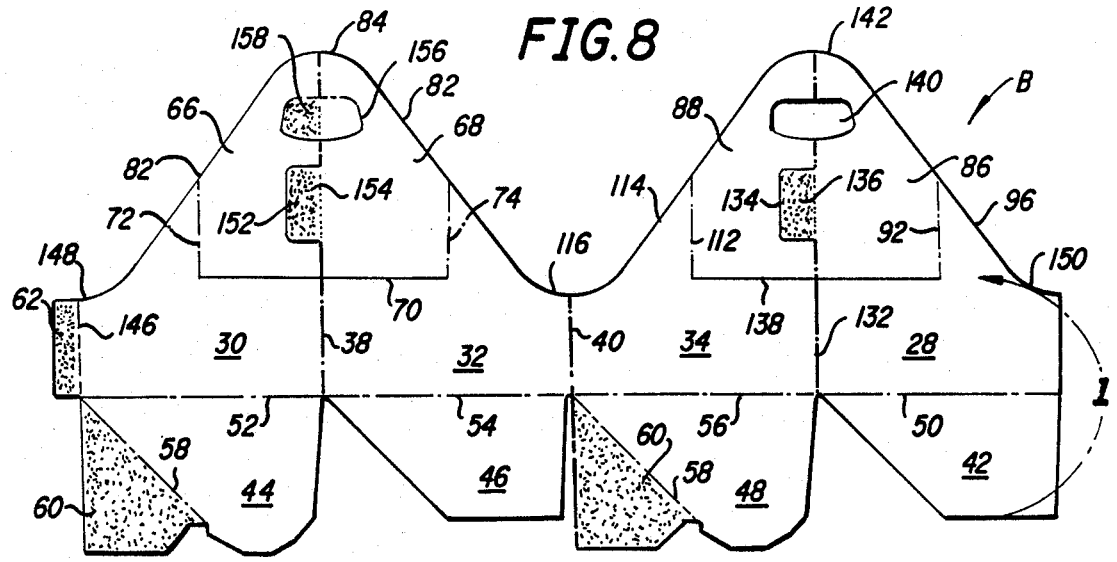
FIG. 8
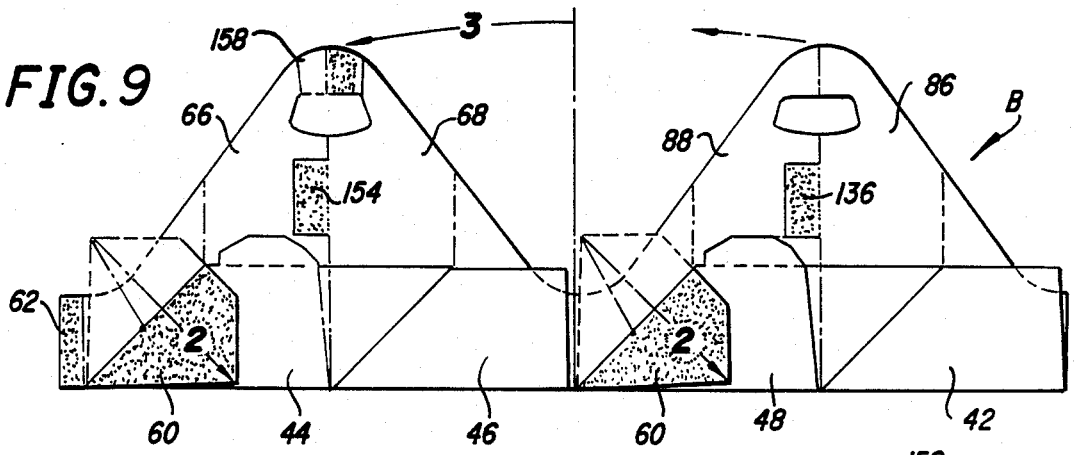
FIG. 9
FIG. 10
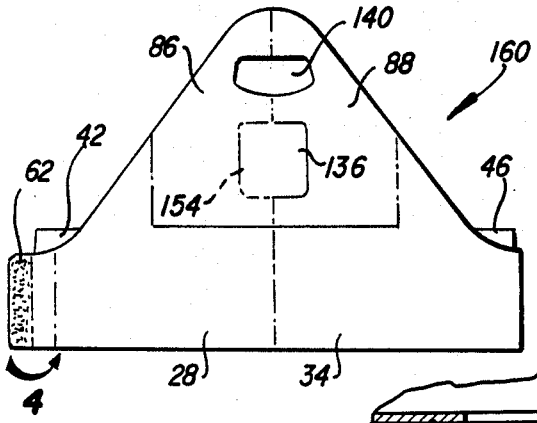
FIG. 11
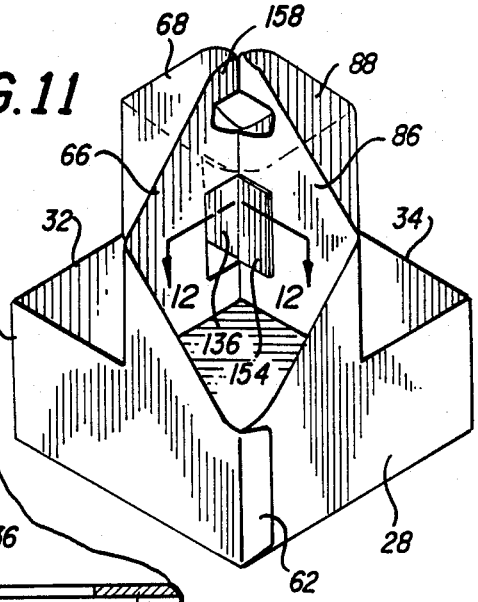
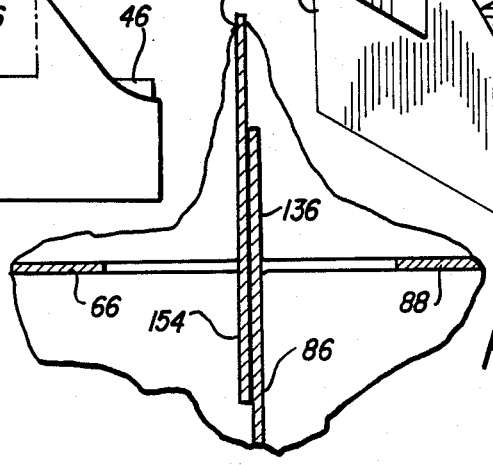
FIG. 12

BASKET CARRIER AND INTERNESTING BLANKS THEREFOR

This is a continuation-in-part of my copending prior application Ser. No. 06/940,617 filed Dec. 11, 1986, now U.S. Pat. No. 4,782,943.

Blanks for basket carriers and the like are cut from a continuous web so as to have a minimum waste. Although the blanks for my earlier basket carrier generally internested, there was an undesirable certain degree of waste. It has now been found that by providing two different blanks to form the same overall basket carrier, a full nesting between the two different blanks is obtainable, thereby minimizing waste in the formation of the blanks.

My original blank construction includes four handles or handle portions two of which are arranged in a single formation at opposite ends of the blank with the other two being joined together at the center of the blank. In accordance with this invention, the new blank also includes four handles, but the handles are provided in sets of twos. As a result, the two handle arrangement of my prior blank will nest exactly between the two sets of handles of the new blank, while the two sets of handles of the new blank will nest between the end handles and the central double handle of my prior blank.

The new blank of this invention differs from the prior blank in that it is provided with an entirely different arrangement of glue flaps which permit the blank to be readily assembled into a flat carrier which then corresponds substantially to the original carrier and which may be readily erected.

With the above and other objects in view that will hereinafter appear, the nature of the invention will be more clearly understood by reference to the following detailed description, the appended claims, and the several views illustrated in the accompanying drawings.

FIG. 1 is a schematic plan view showing the different carrier blanks arranged two wide on a web and being disposed in nested relation.

FIG. 2 is a plan view of my original basket carrier blank with minor modifications and has indicated thereon a first folding operation.

FIG. 3 is a plan view of the blank of FIG. 2 after the first folding operation and shows the manner in which second, third and fourth folding operations may be effected.

FIG. 4 is a plan view of the blank of FIG. 2 after the four folding operations and indicates that fifth and final folding operation.

FIG. 5 is a plan view of the folded blank of FIG. 2.

FIG. 6 is an enlarged perspective view with parts broken away of the erected basket carrier formed from the blank of FIG. 2.

FIG. 7 is a schematic top plan view of a second basket carrier showing the arrangement of the glue flaps.

FIG. 8 is an enlarged plan view of the second basket carrier blank and has identified thereon a first folding step.

FIG. 9 is a plan view similar to FIG. 8 with the first folding step being completed and second and third folding steps being identified.

FIG. 10 is a plan view of the folded blank of FIG. 8 ready for a final folding step.

FIG. 11 is a top perspective view of the second basket carrier.

FIG. 12 is an enlarged fragmentary horizontal sectional view taken generally along the line 12—12 of FIG. 11 and shows the arrangement of the glue flaps joining together the handles.

Referring now to the drawings in detail, reference is first made to FIG. 1 wherein there is illustrated a portion only of a web W. That portion of the web W which is illustrated is of sufficient size to receive four basket carrier blanks. The blanks are arranged two wide on the web, the web W being of a prescribed width to generally match the two wide arrangement. It is to be particularly noted that there are two different blanks, one being blank A and one being blank B. The blanks A are arranged in end-to-end relation as are the blanks B. On the other hand, lengthwise of the web W, a blank A is internested with a blank B.

At this time it is pointed out that while the blanks A and B are different, the blanks will form basket carriers which are functionally the same although slightly structurally different.

The blank A will be discussed first. First of all, it is to be understood that the blank A is basically the subject of the aforementioned U.S. application Ser. No. 940,617 but with slight modifications.

The blank A may be broadly divided into two portions, a base portion 20 and a combined handle and partition portion 22. The base portion 20 includes a body portion 24 and a bottom portion 26.

The body portion 24 is formed of four body panels or side walls 28, 30, 32 and 34 which are joined together along vertical fold lines 36, 38 and 40, respectively.

The bottom portion 26 is defined by bottom panels 42, 44, 46 and 48 which are joined to the lower edges of the respective body panels 28, 30, 32 and 34 along fold lines 50, 52, 54 and 56, respectively. Each of the bottom panels 44, 48 has connected thereto along a diagonal fold line 58 a generally triangular glue flap 60.

The body panel 28 is also provided along the free edge thereof with a glue flap 62.

The combined handle and partition portion 22 includes a central handle member 64 which includes handles 66, 68, disposed in back-to-back relation and hingedly connected together along an extension of the fold line 38.

The handle member 64 includes a cut line 70 which extends transversely of the fold line 38 and is formed equally in the two handles 66, 68. At opposite ends of the cut line 70 are vertical fold lines 72, 74 formed respectively in the handles 66, 68.

A weakening line 76 and a companion weakening line 78 are fomred in the handles 66, 68, respectively, and together they define a panel 80 which could be removed if desired, to form finger opening.

The combined handle and partition portion 22 also includes a pair of single handles 86, 88 which are disposed at opposite ends of the blank A and are integrally connected to the body panels 28 and 34, respectively. The handle 86 is provided with a cut line 90 which extends inwardly from the left edge of the blank A and terminates at a vertical fold line 92. The free edge of the handle 86 is in the form of a glue flap 94 which is a continuation of the glue flap 62.

The handle 86 is defined by a straight line 96 which converges towards the adjacent straight line 82 and is joined thereto by a radius 98. The upper end of the straight line 96 terminates in a partial radius 100.

The handle 86 has formed in the upper part thereof, generally in alignment with the weakening lines 76, 78, a cut line 102 which defines a finger receiving opening 104. The cut line 102 terminates at the glue flap 94 into weakening lines 106 which define a panel 108 which, like the panel 80, could be removed if so desired.

The handle 88, which is at the opposite end of the blank from the handle 86, is merely a mere image of the handle 86 and has formed therein a transverse cut line 110 which extends from the right edge of the blank to a vertical fold line 112. The handle 88 is in part defined by a straight line 114 which converges towards the straight line 82 and is joined thereto by means of a radius 116. The straight line 114 terminates at its upper end in a partial radius 118.

The handle 88, along its free side, carries a glue flap 120 which corresponds to the glue flap 94. The upper part of the handle 118 is provided with a cut line 122 which defines a finger receiving opening 124. The cut line 122 terminates at the glue flap 120 in weakening lines 126 which extend across the glue flap 120 and define a panel.

As is shown in FIG. 3, and in accordance with the arrow 1 of FIG. 2, the bottom panels 42, 44, 46 and 48 are folded along their associated fold lines to overlie the side panels. Next, as indicated by the arrow 3, the right portion of the blank is folded into overlying relation to the right hand central portion of the blank with the glue flap 60 thereof bonding to the bottom panel 46. This arrangement is best shown in FIG. 4.

Thereafter the left portion of the blank is folded along the hinge line 36 into overlying relation with respect to the left central portion of the blank as indicated by the arrow 4 in FIG. 4 to complete the forming of the blank into a flat basket carrier identified by the numeral 130 in FIG. 5. At this time it is pointed out that the glue flap 120 is bonded to the handle 66, as is shown in FIG. 4 and the glue flap 94 is bonded to the handle 88 as shown in FIG. 5. Further, the glue flap 62 is bonded to the body panel 34 while the glue flap 60 carried by the bottom panel 44 is bonded to the underside of the bottom panel 42.

The basket carrier 130 may be readily erected from its folded state of FIG. 5 to its operative state of FIG. 6. At this time the respective handles are folded at right angles to the respective sidewalls or side panels as is clearly shown in FIG. 6. Further, the bottom panels automatically form the bottom of the carrier.

With reference to FIG. 7, it will be seen that the handles 66, 68 are disposed at right angles to each other while the handles 86, 88 are at right angles to each other. Further, the glue flap 94 is turned at right angles to the handle 86 while the glue flap 120 forms a straight continuation of the handle 88.

In FIG. 8 there is illustrated the blank B in greater detail. A comparison of FIGS. 2 and 8 will show that the blank B corresponds to the blank A except that the glue flaps 94, 120 have been eliminated and the handle 86, the side panel 28 and the bottom panel 42 are no longer connected to the remainder of the blank along the equivalent of the fold or hinge line 36, but are connected to the handle 88 and the side panel 34 along a fold line 132. It is to be noted that the fold line 132 is interrupted by a generally C-shaped cut line 134 formed in the handle 88 to define a glue flap 136. Further, in lieu of the separate cut lines 90, 110, the lower ends of the fold lines 112, 92 are connected by a cut line 138.

The upper part of the fold line 132 is further interrupted by a cutout 140 defining a finger receiving opening in both of the handles 88, 86.

Inasmuch as the handles 88, 86 are now joined together to form a single projection, the straight line borders 114, 96, thereof are interconnected by a radius 142.

At the opposite end of the blank B, the glue flap 62 is connected to the body panel 30 along a fold line 146. Also, the straight lines 82, 96 terminate at their lower ends in partial radii 148, 150. Finally, the fold or hinge line 38 is interrupted by a C-shaped cut 152 in the handle 66 to define a further glue flap 154. The upper part of the fold line 38 is further interrupted by a combined cut and weakening line 156 which defines a hinged flap 159 having adhesive on one half of one side and adhesive on the other half of the other side. The glue flap 158 is to be folded upwardly and initially bonded to the upper part of the handle 66.

The first step in folding the blank B into a basket carrier is to fold the bottom panels 44, 46, 48 and 42 up into overlying relation with respect to the respective ones of the side panels 30, 32, 34, 28 as indicated by the arrow 1 in FIG. 8 and most specifically illustrated in FIG. 9. Then the glue flaps 60 are reversely folded into overlying relation with respect their respective bottom panels 44, 48 as indicated by the arrow 2. Thereafter, the right half of the partially folded blank B is folded along the transverse fold line 40 into overlying relation with respect to the left half of the blank B as indicated by the arrow 3 and as best shown in FIG. 10. At this time the glue flap 136 bonds to the handle 68 while the glue flap 154 bonds to the handle 86. In a like manner, the glue flaps 60 bond to the bottom panels 42, 46. Then, as is shown in FIG. 10, the glue flap 62 is folded into overlying relation with respect to the side panel 28 to complete the folded basket carrier which is identified by the numeral 160. It is to be noted, however, at this time that when the handle 86 is folded into overlying relation with respect to the handle 68, the right hand side of the glue flap 158, as viewed in Figure 9, becomes bonded to the handle 88 to complete the joint at the top of the basket carrier.

It is to be understood that the completed basket carrier 160 will be erected in the same manner generally described with respect to the basket carrier 130. The handles 66, 68, 88, 86 now function both as handles and dividers. It is to noted that the handles 66, 68 are at right anles to one another while the handles 86, 88 are at right angles to one another. This is clearly illustrated in Figure 12.

Although the blanks have been illustrated in a two wide arrangement on the web W, it is to be understood that it is feasible for the web to be wider to accept blanks of a greater number and width, or to be narrower to have only a single set of blanks extending trasversely thereon.

Although only specific blank arrangements and basket carriers to be formed therefrom have been illustrated and described herein, it is to be understood that minor variations may be made in the blanks and the resultant carriers without departing from the spirit and scope of the invention as defined by the appended claims.

I claim:

1. A blank arrangement for forming basket carriers from a web with minimum waste, said basket carriers each having four handles, said blank arrangement comprising at least two blanks arranged in handle-to-handle relation, one of said blanks having one double handle central projection and two single handle outer projections, and the other of said blanks having two spaced double handle projections, and said one double handle central projection being disposed between said two double handle projections.

2. A blank arrangement according to claim 1 wherein said blanks are separated by a single continuous cut line.

3. A blank arrangement according to claim 1 wherein each of said blanks also include body panels forming extensions of said handle projections, and bottle forming panels and flaps carried by said body panels.

4. A blank arrangement according to claim 3 wherein one of said body panels has a glue flap for bonding said body panels together and each of said double handle projections has an interior glue flap for joining handles of said double handle projections together.

5. A blank arrangement according to claim 3 wherein one of said body panels has a glue flap for bonding said body panels together and each of said single handle projections has a glue flap for joining said single handle projections together.

6. A blank arrangement according to claim 5 wherein said body panel glue flap is longitudinally aligned with one of said handle glue flaps.

7. A blank arrangement according to claim 1 wherein each double handle projection has two sloping sides joined by a first radius, and at least one sloping side of each double handle projection is joined to a sloping side of a next adjacent handle projection by a second radius.

8. A blank arrangement according to claim 7 wherein said first radius and said second radius are the same.

9. A blank arrangement according to claim 7 wherein one of said blanks has two of said first radius and one of said second radius, and the other of said blanks has one of said first radius and two of said second radius.

10. A blank for a basket-like carrier, said blank comprising a lower portion, an intermediate portion and an upper portion, said lower portoin being in the form of a plurality of bottom forming panels and flaps, said intermediate portion being in the form of a plurality of body forming panels, and said upper portion being in the form of a plurality of handles for defining a combined separator and handle structure, said handles including two sets of handles joined togther, each set of handles including two of said handles joined together along a fold line, the configuration of the space between said sets of handles corresponding to the configuration of each of said sets of handles.

11. A blank according to claim 10 wherein one handle of each set of handles has a glue flap for joining to a like handle of the other set of handles.

12. A basket-like carrier comprising a base having a bottom, said base being defined by side walls, and combined separator and handle structure extending upwardly from central portions of said side walls, said combined separator and handle structure including a handle extending from each of said side walls and intersecting like handles in a centrally located vertical line, said handles being arranged in sets with each set including two handles joined along a fold and together having a rounded tip and partially rounded base portions.

13. A carrier according to claim 12 wherein an edge of one of said two adjacent handles and an edge of a next adjacent further one of said handles define a configuration which is identical to the configuration of said two adjacent panel members but inverted.

14. A carrier according to claim 12 wherein one handle of each set of handles has a glue flap joined to a like handle of the other set of handles.

15. A carrier according to claim 14 wherein each glue flap is bonded to the other handle of a respective one of said handle sets.

16. A carrier according to claim 12 wherein one set of handles has a finger receiving opening in an upper portion thereof, one of said finger receiving openings resulting from a folded glue flap bonded to one handle of each set of handles.

17. A blank according to claim 10 wherein one of said sets of handles has a finger receiving opening therein defined by a foldable displacement of a glue flap having adhesive thereon for bonding to one handle of each of said sets of handles.

* * * * *